US005575723A

United States Patent [19]

Take et al.

[11] Patent Number: 5,575,723

[45] Date of Patent: Nov. 19, 1996

[54] GOLF CLUB WITH CUSHION MATERIAL BETWEEN SHAFT AND HEAD

[75] Inventors: Shigeki Take; Shoichi Dekura, both of Tokyo, Japan

[73] Assignee: Daiwa Seiko, Inc., Tokyo, Japan

[21] Appl. No.: 404,432

[22] Filed: Mar. 15, 1995

[30] Foreign Application Priority Data

Mar. 17, 1994 [JP] Japan ..... 6-047272

[51] Int. Cl.[6] ..... A63B 53/02

[52] U.S. Cl. ..... 473/305; 473/310; 473/345

[58] Field of Search ..... 273/80 R, 80.2, 273/80.3, 80.4, 80.5, 167 H, 167 K; 473/305, 310, 311, 318, 332, 345

[56] References Cited

U.S. PATENT DOCUMENTS

| | | | |
|---|---|---|---|
| 1,551,563 | 9/1925 | Heller | 273/80.4 |
| 2,153,880 | 4/1939 | Barnhardt | 273/80.4 |
| 2,282,614 | 5/1942 | Smith | 473/310 |
| 3,810,621 | 5/1974 | Mills | 273/167 K |
| 5,335,909 | 8/1994 | Green, Jr. | 473/310 |
| 5,377,979 | 1/1995 | Long | 473/310 |
| 5,452,890 | 9/1995 | Bingman | 473/310 |

FOREIGN PATENT DOCUMENTS

| | | | |
|---|---|---|---|
| 63-17490 | 5/1988 | Japan . | |
| 5-96031 | 4/1993 | Japan . | |
| 2225726 | 6/1990 | United Kingdom | 273/80.2 |

*Primary Examiner*—William M. Pierce
*Attorney, Agent, or Firm*—Longacre & White

[57] ABSTRACT

The invention concerns a golf club of metal which can withstand an impact produced when hitting a ball, and reduces the transmission of vibration to a shaft when hitting the ball, thereby giving a soft ball-hitting feel. In the metal golf club, a pair of shaft support portions are provided respectively at a top portion side and a sole portion side of a head body, i.e. a hollow shell cast of metal. A shaft inserted into the head body is supported at two points by the two shaft support portions. A cushioning member of a synthetic resin is interposed between each of the shaft support portions and the shaft.

19 Claims, 2 Drawing Sheets

GOLF CLUB WITH CUSHION MATERIAL BETWEEN SHAFT AND HEAD

BACKGROUND OF THE INVENTION

This invention relates to a metal golf club in which a shell of a head body is cast of metal.

Recently, in view of the stability of quality, the ease of supply of materials and so on, metal golf clubs in which a shell of a head body is cast of metal such as stainless steel, titanium and an aluminum alloy, have been extensively used as so-called "wood clubs" instead of golf clubs made of natural wood such as persimmon and cherry.

Among a set of golf clubs, the wood clubs are used to hit a golf ball the hardest to get a long flying distance, and therefore if the strength of joint between a head body and a shaft is low, there is a possibility that the head body may be separated from the shaft by an impact produced when hitting the ball, thus resulting in the damaged golf club.

Therefore, there has been proposed a golf club 9 (FIG. 4) as disclosed in Japanese Utility Model Examined Publication No. 63-17490 in which cylindrical shaft support portions 3 and 5 are formed integrally respectively at a top portion 1*a* and a sole portion 1*b* of a head body 1 at the heel side thereof. There has been proposed another golf club 19 (FIG. 5) as disclosed in Japanese Patent Unexamined Publication No. 5-96031 in which a hosel insertion portion 13 extends obliquely generally vertically through a head body 11 from a top portion 11*a* to a sole portion 11*b* of the head body 11 at the heel side thereof, and a shaft 17 is inserted into the hosel insertion portion 13 through a hosel 15 of a fiber-reinforced plastics material.

However, generally, a metal golf club of this type having a metal-cast shell on a head body, gives a ball-hitting feel that is harder than that of a golf club made of persimmon or cherry, and even in the conventional golf club shown in FIG. 4, since the shaft 7 is in direct contact with the head body 1 through the two support portions 3 and 5, vibration produced when hitting the ball is transmitted directly to the shaft 7, so that a soft ball-hitting feel can not be obtained, and besides there is a fear that this vibration may adversely affect the elbow of the player.

On the other hand, in the conventional golf club shown in FIG. 5, the shaft 17 is inserted into the head body 11 through the hosel 15 of a fiber-reinforced plastics material; however, since the peripheral wall of the hosel insertion portion 13 integral with the head body 11 is provided around the entire periphery of that portion of the shaft 17 disposed in the head body 11, hard vibration, produced when hitting the ball, is transmitted from the whole of the hosel insertion portion 13 to the shaft 17, thus causing a disadvantage that a soft ball-hitting feel can not still be obtained.

SUMMARY OF THE INVENTION

The present invention has been made in view of the above problems, and an object of the invention is to provide a golf club of metal which can withstand an impact produced when hitting a ball, and reduces the transmission of vibration to a shaft when hitting the ball, thereby giving a soft ball-hitting feel.

To achieve the above object, the present invention provides a metal golf club wherein a pair of shaft support portions are provided respectively at a top portion side and a sole portion side of a head body comprising a hollow shell cast of metal; a shaft inserted into the head body is supported at two points, i.e. the two shaft support portions; and a cushioning member is interposed between each of the shaft support portions and the shaft.

The cushioning member is made of a material softer than the head body and the shaft, and preferably of a synthetic resin.

When hitting a golf ball by the golf club according to the present invention, the shaft support portions firmly support the shaft, and also the cushioning member absorbs an impact produced when hitting the ball, thereby reducing the impact to be transmitted from the head body to the shaft.

Besides, in the invention, the shaft is supported at the two points by the shaft support portions, and that portion of the shaft disposed in the head body is not supported around its entire periphery by a peripheral wall (as in the conventional construction) integral with the head body, and therefore the amount of vibration to be transmitted from the head body to the shaft is greatly reduced as compared with the conventional construction.

DETAILED DESCRIPTION OF THE PREFERRED EMBODIMENTS

Preferred embodiments of the present invention will now be described with reference to the drawings.

Figure 1:
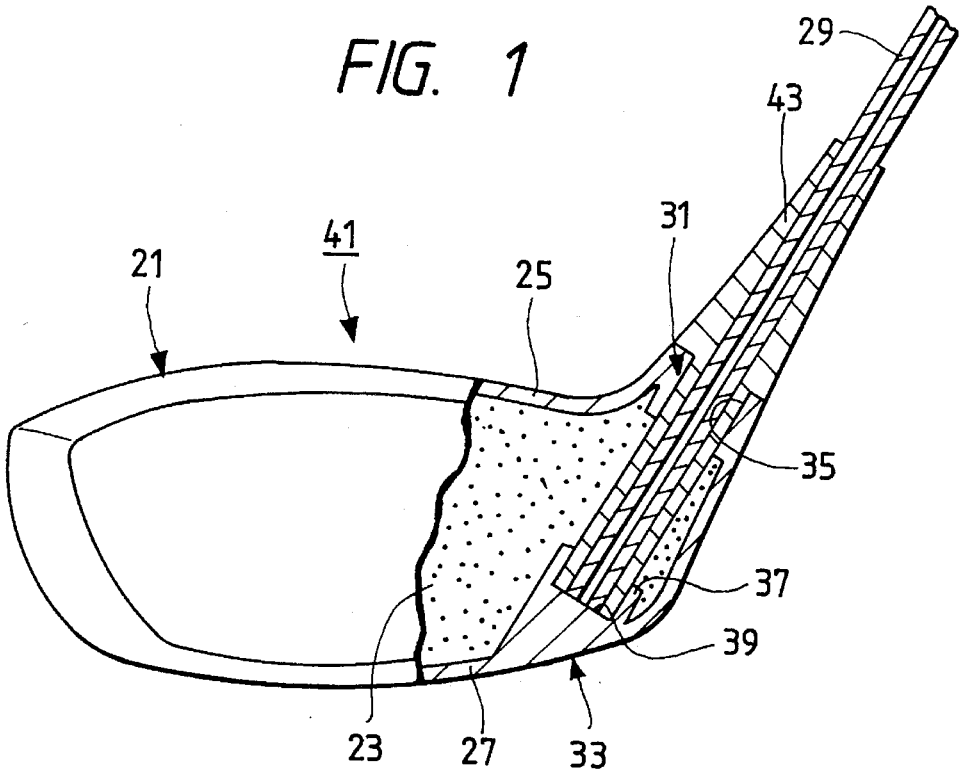
FIG. 1 is a cross-sectional view of an important portion of a first embodiment of a metal golf club of the invention.

FIG. 1 shows a first embodiment of a golf club of the present invention, and reference numeral 21 designates a head body which is a hollow shell cast of metal such as stainless steel, titanium and an aluminum alloy. A filler 23 such as a foamed synthetic resin is filled in this head body 21. Shaft support portions 31 and 33 for supporting a shaft 29 are formed respectively at a top portion 25 and a sole portion 27 of the head body 21 at the heel side thereof.

The shaft support portion 31 is constructed such that a portion of the top portion 25 of the head body 21 disposed at the heel side is projected obliquely upwardly and a shaft insertion hole 35 is formed to extend in a direction of insertion of the shaft 29. On the other hand, the shaft support portion 33, provided at the sole portion 27 of the head body 21, includes a fitting projection 37 projecting into the head body 21 in the direction of insertion of the shaft 29, and a shaft-fitting recess 39 formed in a distal end of this fitting projection. These shaft support portions 31 and 33 are preferably formed cylindrical to firmly support the shaft 29.

The shaft 29, made of metal or a synthetic resin such as FRP, is inserted into the shaft insertion hole 35, and the insertion-side end of this shaft is fitted in the fitting recess 39. A cushioning member 43 of a configuration like a hosel is provided around the entire periphery of the insertion-side end portion of the shaft 29, the cushioning member 43 being made of a synthetic resin (e.g. an ABS resin, a polycarbonate resin, an epoxy resin or a mixture thereof with carbon, Kevlar or glass powders or fibers) softer than the head body 21 and the shaft 29. The shaft 29 is supported at two points by the shaft support portions 31 and 33 through the cushioning member 43.

The cushioning member 43 may beforehand be integrally attached to the end portion of the shaft 29 to be inserted, and then may be inserted into the shaft insertion hole 35, together with the shaft 29, to be fitted in the shaft-fitting recess 39. Alternatively, the cushioning member 43 may be secured to the head body 21 independently of the shaft 29, and then the shaft 29 may be inserted into the cushioning member 43.

With this construction of the golf club 41 of the invention, when hitting a golf ball by this golf club 41, the shaft support portions 31 and 33 firmly support the shaft 29, and the cushioning member 43 absorbs an impact produced when hitting the ball, thereby reducing the impact to be transmitted from the head body 21 to the shaft 29.

Besides, the shaft 29 of this embodiment is supported at the two points by the shaft support portions 31 and 33, and that portion of the shaft 29 disposed in the head body 21 is not supported around its entire periphery by a peripheral wall (as in the conventional construction of FIG. 5) integral with the head body 21, and therefore the amount of vibration to be transmitted from the head body 21 to the shaft 29 is greatly reduced as compared with the conventional construction.

Figure 4:
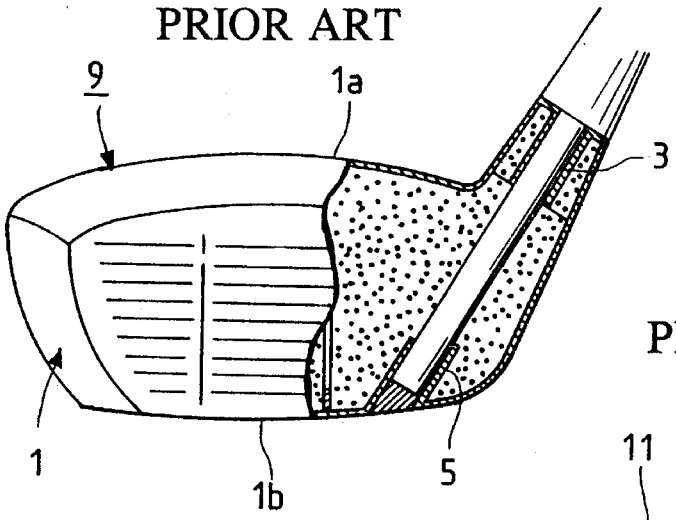
FIG. 4 PRIOR ART
FIG. 4 is a cross-sectional view of an important portion of a conventional metal golf club.
Figure 5:
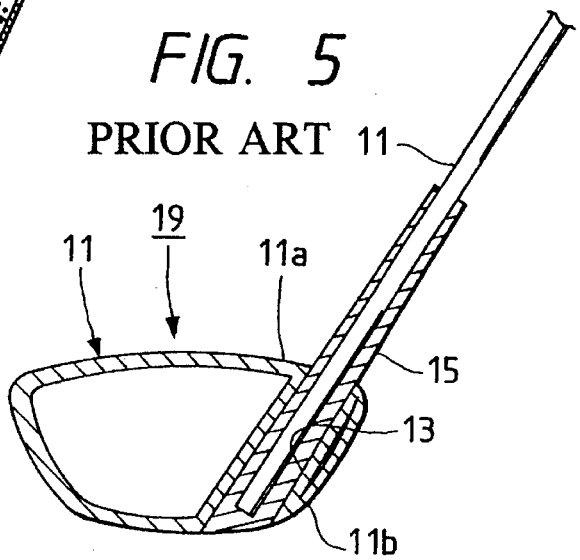
FIG. 5 PRIOR ART
FIG. 5 is a cross-sectional view of an important portion of another conventional metal golf club.

Thus, in this embodiment, the vibration, transmitted from the head body 21 to the shaft 29 when hitting the ball is reduced to a lower level as compared with the conventional construction of FIG. 5, and besides the impact produced at this time is absorbed by the cushioning member 43, so that a softer ball-hitting feel can be obtained as compared with the conventional constructions of FIGS. 4 and 5.

In the above-mentioned conventional construction of FIG. 5, since the peripheral wall of the hosel insertion portion 13 integral with the head body 11 is provided around the entire periphery of that portion of the shaft 17 disposed in the head body 11, the weight of the head body 11 is heavy at its heel side.

In this embodiment, however, the shaft support portions 31 and 33 are respectively provided only at the top portion 25 and the sole portion 27 of the head body 21 at the heel side thereof, and a peripheral wall such as the above-mentioned hosel insertion portion 13 is not provided. Therefore, the weight of the head body 21, particularly at the heel side, can be reduced, and as a result the head body 21 can be cast or formed into a larger size, thus providing an advantage that a sweet spot can be enlarged. Further, the reduction of the weight of the head body 21 at the heel side makes it easy to balance the head body 21 between the toe side and the heel side.

Figure 2:
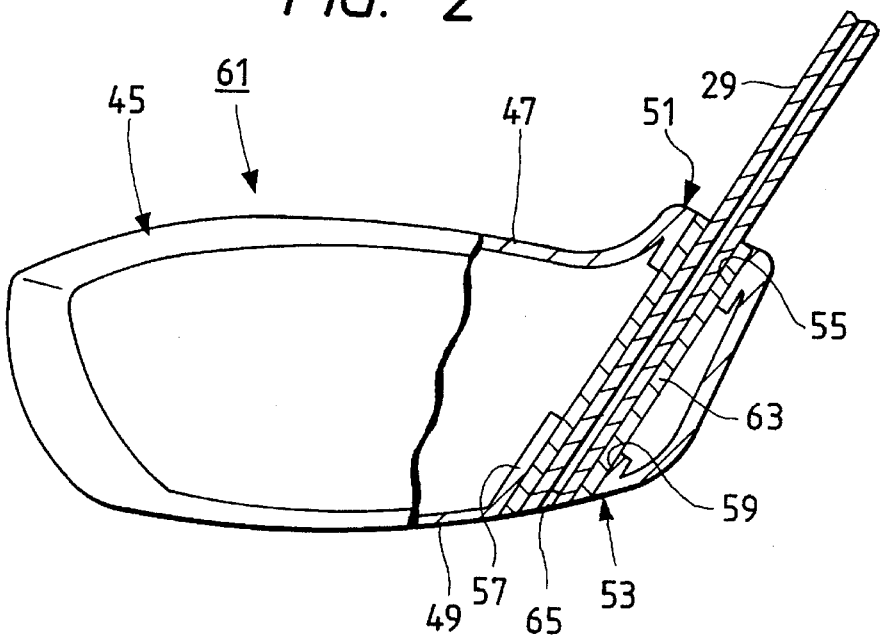
FIG. 2 is a cross-sectional view of an important portion of a second embodiment of a metal golf club of the invention.

FIG. 2 shows a second embodiment of a golf club of the present invention, and a head body 45, like the above-mentioned head body 21, is formed as a hollow shell cast of metal such as stainless steel, titanium and an aluminum alloy. Shaft support portions 51 and 53 for supporting a shaft 29 at two points as in the above embodiment are formed respectively at a top portion 47 and a sole portion 49 of the head body 45 at the heel side thereof.

The shaft support portion 51, like the above-mentioned shaft support portion 31, is formed by obliquely upwardly projecting that portion of the top portion 47 of the head body 45 disposed at the heel side, and has a shaft insertion hole 55 extending in a direction of insertion of the shaft 29. The outer configuration of this shaft support portion 51 is a little more rounded than that of the above-mentioned shaft support portion 31. The shaft support portion 53, provided at the sole portion 49, includes a fitting projection 57 projecting into the head portion 45 in the direction of insertion of the shaft 29, and a shaft-fitting hole 59 formed coaxially with this fitting projection 57.

The shaft 29 is inserted into the shaft insertion hole 55, and the insertion-side end of this shaft is fitted in the shaft-fitting hole 59. A tubular cushioning member 63, made of the same material as that of the above-mentioned cushioning member 43, is mounted around the entire periphery of that portion of the shaft 29 disposed in the head body 45. The shaft 29 and the cushioning member 63 are inserted into the shaft-fitting hole 59, and are adhesively bonded in such a manner that their insertion-side ends are disposed generally flush with a bottom surface of the sole portion 49. An opening of the insertion-side end of the shaft 29 exposed to the sole portion 49 is closed by a closure member 65 formed of metal or a synthetic resin, so that this closed end lies generally flush with the sole portion 49.

In this embodiment, also, the cushioning member 63 may beforehand be integrally attached to the end portion of the shaft 29 to be inserted, and then may be inserted into the shaft insertion hole 55, together with the shaft 29, to be fitted into the shaft-fitting hole 59. Alternatively, the cushioning member 63 may be secured to the head body 45 independently of the shaft 29, and then the shaft 29 may be inserted into the cushioning member 63.

With this construction of the golf club 61 of the invention, when hitting a golf ball by this golf club 61, the shaft support portions 51 and 53 firmly support the shaft 29, and the cushioning member 63 absorbs an impact produced when hitting the ball, thereby reducing the impact to be transmitted from the head body 45 to the shaft 29, as described above for the first embodiment.

Besides, the shaft 29 of this embodiment is also supported at the two points by the shaft support portions 51 and 53, and that portion of the shaft 29 disposed in the head body 45 is not supported around its entire periphery by a peripheral wall (as in the conventional construction of FIG. 5) integral with the head body 21, and therefore the amount of vibration to be transmitted from the head body 45 to the shaft 29 is greatly reduced as compared with the conventional construction.

Therefore, in this embodiment, also, the vibration, transmitted from the head body 45 to the shaft 29 when hitting the ball is reduced to a lower level as compared with the conventional construction of FIG. 5, and besides the impact produced at this time is absorbed by the cushioning member 63, so that a softer ball-hitting feel can be obtained as compared with the conventional golf clubs. Furthermore, as in the above first embodiment, there is provided an advantage that a sweet spot can be enlarged by increasing the size of the head body 45.

Further, since the head main body 45 has two openings respectively at the top side and the sole side, the cushioning member 63 can be installed inside the head body 45 with ease.

Figure 3:
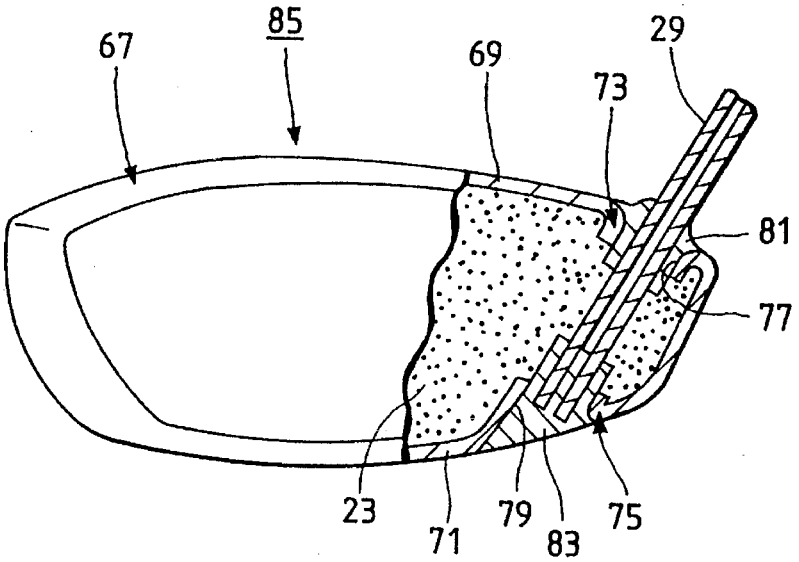
FIG. 3 is a cross-sectional view of an important portion of a third embodiment of a metal golf club of the invention.

FIG. 3 shows a third embodiment of a golf club of the present invention, and a hollow head body 67 is cast of the same metal as that of the above-mentioned head body 21. Shaft support portions 73 and 75 for supporting a shaft 29 at two points as in the above embodiments are formed respectively at a top portion 69 and a sole portion 71 of the head body at the heel side thereof.

In this embodiment, the shaft support portions 73 and 75 are formed respectively by inwardly bending relevant portions of a shell, constituting the head body 67, so that these shaft support portions have their respective shaft insertion holes 77 and 79. The shaft insertion holes 77 and 79 are respectively filled with and closed by cushioning members 81 and 83 made of the same material as that of the above-mentioned cushioning member 43. The shaft 29 is supported at two points by the shaft support portions 73 and 75 in such a manner that the shaft 29 extends through the cushioning member 81 into the cushioning member 83.

With this construction of the golf club 85 of the invention, when hitting a golf ball by this golf club 85, the shaft support portions 73 and 75 firmly support the shaft 29 on the head body 67, and the cushioning members 81 and 83 absorbs an impact produced when hitting the ball, thereby reducing the impact to be transmitted from the head body 67 to the shaft 29, as described above for the first embodiment.

Besides, the shaft 29 of this embodiment is also supported at the two points by the shaft support portions 73 and 75, and that portion of the shaft 29 disposed in the head body 67 is not supported around its entire periphery by a peripheral wall (as in the conventional construction of FIG. 5) integral with the head body 67, and therefore the amount of vibration to be transmitted from the head body 67 to the shaft 29 is greatly reduced as compared with the conventional construction.

Therefore, in this embodiment, also, the vibration, transmitted from the head body 67 to the shaft 29 when hitting the ball is reduced to a lower level as compared with the conventional construction of FIG. 5, and besides the impact produced at this time is absorbed by the cushioning members 81 and 83, so that a softer ball-hitting feel can be obtained as compared with the conventional golf clubs. Furthermore, as in the above first embodiment, there is provided an advantage that a sweet spot can be enlarged by increasing the size of the head body 67.

In the embodiment, the support portion 73 is formed by inwardly bending a portion of the head body 67 and the cushioning member 81 is made substantially flush with a top 69 of the head body 67 to provide no hosel portion. Thus, this structure of this embodiment contributes to the reduction of the entire weight of the golf club head 85 and makes it possible to lower the center of gravity of the golf club head 85.

In the above embodiments, although the shaft support portions are provided at the top portion and the sole portion, respectively, the present invention is not limited to such an arrangement, and the shaft need only to be supported at two points at the top portion side and the sole portion side.

As described above, in the golf club according to the present invention, there is no fear that the head body and the shaft will be separated from each other by an impact produced when hitting the ball, and besides vibration to be transmitted from the head body to the shaft when hitting the ball is reduced to a lower level as compared with the conventional construction, and also the cushioning member absorbs this impact. Therefore, a softer ball-hitting feel can be obtained as compared with the conventional golf club, and there is achieved an advantage that a larger sweet spot can be obtained by increasing the size of the head body.

What is claimed is:

1. A metal golf club having a head body formed as a hollow shell case of metal, said club comprising;

a filler material substantially filling said hollow shell case;

a pair of shaft support portions provided respectively at a top portion side and a sole portion side of said head body, said support portions being separated from each other;

a shaft inserted into said head body and supported by said shaft support portions;

a top cushioning member interposed between said shaft support portion and said shaft at said top portion side of said head body; and a bottom cushion member interposed between said shaft support portion and said shaft at said sole portion of said head body, said bottom cushion member being separate from said top cushion member defining a gap therebetween, wherein said shaft contacts said filler material.

2. A metal golf club having a head body formed as a hollow shell case of metal, said club comprising;

a pair of shaft support portions provided respectively at a top portion side and a sole portion side of said head body, said support portions being separated from each other;

a shaft inserted into said head body and supported by said shaft support portions; and a cushioning member interposed between each of said shaft support portions and said shaft;

wherein said cushioning member is protruded from said head body obliquely upwardly to integrally form a hosel having a shaft insertion hole.

3. A metal golf club according to claim 1, wherein said cushioning member is made of a synthetic resin.

4. A metal golf club according to claim 1, wherein said head body is formed of one of stainless steel, titanium and aluminum alloy.

5. A metal golf club according to claim 1, wherein said cushioning member is made of a material softer than said head body.

6. A metal golf club according to claim 1, wherein said cushioning member is made of a material softer than said shaft.

7. A metal golf club according to claim 1, wherein said shaft is in no-contact with said head body.

8. A metal golf club according to claim 1, wherein an axial end of said shaft is flush with a sole surface of said head body.

9. A metal golf club according to claim 1, wherein said cushioning member is formed of an ABS resin, a polycarbonate resin, an epoxy resin or a mixture thereof with carbon, kevlar or glass powders or fibers.

10. A metal golf club according to claim 1, wherein each of said support portions is protruded into the inside of said hollow shell.

11. A metal golf club according to claim 1, wherein each of said support portions is cylindrical

12. A metal golf club according to claim 1, wherein an end of said cushioning member is substantially flush with a top surface of said head body.

13. A metal golf club according to claim 1, wherein said shaft is inserted into said cushioning member.

14. A metal golf club according to claim 1, wherein said cushioning member extends from one of said support portions to the other.

15. A metal golf club according to claim 1, wherein said cushioning member is protruded from each of said support portions inwardly.

16. A metal golf club according to claim 1, wherein a radial thickness of said cushioning member is substantially equal to or greater than a radial thickness of said support portions.

17. A metal golf club having a head body formed as a hollow shell case of metal, said club comprising;

a pair of shaft support portions provided respectively at a top portion side and a sole portion side of said head body, said support portions being separated from each other;

a shaft inserted into said head body and supported by said shaft support potions;

a top cushioning member interposed between said shaft support portion and said shaft at said top portion side of said head body; and a bottom cushion member interposed between said shaft support portion and said shaft at said sole portion of said head body, said bottom cushion member being separate from said top cushion member defining a gap therebetween, wherein said shaft is hollow and open at is lower end to expose an internal surface; and said bottom cushioning member having a portion extending into said opening of said shaft contacting said internal surface of said shaft.

18. A metal golf club according to claim 17, wherein said top cushioning member is protruded from said head body obliquely upwardly to integrally form a hosel having a shaft insertion hole.

19. A metal golf club having a head body formed as a hollow shell case of metal, said club comprising;

a pair of shaft support portions provided respectively at a top portion side and a sole portion side of said head body, said support portions being separated from each other;

a shaft inserted into said head body and supported by said shaft support potions;

a top cushioning member interposed between said shaft support portion and said shaft at said top portion side of said head body; and a bottom cushion member interposed between said shaft support portion and said shaft at said sole portion of said head body, said bottom cushion member being separate from said top cushion member defining a gap therebetween, wherein said top cushioning member is protruded from said head body obliquely upwardly to integrally form a hosel having a shaft insertion hole.

* * * * *